US006869300B2

(12) United States Patent
Lefki et al.

(10) Patent No.: US 6,869,300 B2
(45) Date of Patent: Mar. 22, 2005

(54) SUPPLY CONNECTOR FOR A DISCHARGE LAMP

(75) Inventors: Karim Malek Tewfik Lefki, Chartres (FR); Philippe De Montureux, Versailles (FR); Ahmed Mokhtari, Chartres (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/483,026

(22) PCT Filed: Jul. 4, 2002

(86) PCT No.: PCT/IB02/02764

§ 371 (c)(1),
(2), (4) Date: Jan. 6, 2004

(87) PCT Pub. No.: WO03/007434

PCT Pub. Date: Jan. 23, 2003

(65) Prior Publication Data

US 2004/0171291 A1 Sep. 2, 2004

(30) Foreign Application Priority Data

Jul. 10, 2001 (FR) ..... 01 09170

(51) Int. Cl.[7] ..... H01R 33/08

(52) U.S. Cl. ..... 439/242; 439/230; 439/232; 362/226

(58) Field of Search ..... 439/242–244, 439/226, 230, 232–233, 168, 182, 220, 280, 356, 360, 366, 375, 558, 602, 605, 611, 699.2, 702, 753, 890; 362/226

(56) References Cited

U.S. PATENT DOCUMENTS

| | | | | | |
|---|---|---|---|---|---|
| 1,673,610 | A | * | 6/1928 | Weizsaeker | 439/235 |
| 1,890,680 | A | * | 12/1932 | Harase | 439/242 |
| 2,464,643 | A | * | 3/1949 | Kulka | 439/244 |
| RE30,367 | E | * | 8/1980 | Belokin, Jr. | 439/230 |
| 4,842,535 | A | * | 6/1989 | Velke et al. | 439/232 |

* cited by examiner

*Primary Examiner*—P. Austin Bradley
*Assistant Examiner*—Felix O. Figueroa

(57) ABSTRACT

The invention relates to a supply connector (10) for a discharge lamp (12) of the type which includes an insulating housing (18) in which an opening (56) is provided for the axial introduction of a free end (26) of the glass body (28) of the discharge lamp (12) including a longitudinal electrode (30) formed by a front section (32) which extends to the exterior of the body (28) and a rear section (34) which extends inside a front section (36) of the free end of the body (28) and which is designed to be supplied with a direct current, and of the type in which a contact blade (20) is formed, which blade cooperates with the front section (32) of the electrode (30) for connecting the lamp (12) to an electrical supply member, characterized in that it includes an electrically conducting ring (22) which is connected to ground, which is axially traversed by the front section (36) of the free end of the glass body (28), and which is designed to be at least partly in contact with a portion (150) of the outer wall of the glass body (28) of the discharge lamp (12) so as to facilitate the ignition of the latter.

12 Claims, 4 Drawing Sheets

SUPPLY CONNECTOR FOR A DISCHARGE LAMP

The invention relates to a supply connector for a discharge lamp.

The invention more in particular offers a supply connector for a discharge lamp of the type which comprises an insulating housing.

Discharge lamps are formed by a hollow body filled with an inert gas such as neon. The body is usually a glass tube which may be straight or curved. The emission of a luminous flux is caused by the creation of an electric arc through the gas.

There are two types of discharge lamps: those which operate with an alternating current and those which operate with a direct current.

The discharge lamps which operate with an alternating current comprise an electrode at either end, which electrode may be formed by a filament and is supplied with a positive voltage and a negative voltage alternately. Each electrode thus performs the function of an anode and of a cathode in alternation. The absolute value of the applied voltage is of the order of 1000 volts.

The alternating voltage applied to the electrode leads to a rise in temperature. Lamps of this type are accordingly also denoted discharge lamps with "hot" electrodes.

In addition, the electrical supply unit of such discharge lamps generates a major amount of electromagnetic radiation, which may interfere with the operation of other electrical devices located in the vicinity.

The discharge lamps which operate with a direct current comprise an electrode at either end, which electrodes may be formed by a cylindrical element of which a section extends into the body and another section extends to the exterior. One of the electrodes, the anode, is supplied with a voltage and the other electrode, the cathode, is connected to ground. The voltage applied to the anode during operation is of the order of 4000 volts.

Still, the ignition of discharge lamp operating on direct current is sometimes difficult to achieve.

A known solution for alleviating this problem is to increase the supply voltage. This, however, leads to an increase in the cost of the elements used, which must be resistant to the higher voltages.

Another solution is to coat the electrodes with graphite. This increases the number of process steps in the manufacture of the lamp, which in its turn leads to a higher cost price.

It is also possible to inject a small quantity of radioactive gas into the interior of the body. The disadvantages of such a solution are evident, because radioactive elements are dangerous for human health. It is necessary to ensure conditions of storage and use which are very strict and which considerably increase the cost of such lamps, rendering any profitable use thereof improbable.

The problem of igniting discharge lamps, especially those which operate on direct current, has thus not been resolved.

With this type of lamp, moreover, there is a major risk of short-circuits between the outer portion of the anode and conducting elements such as metal parts of the installation because of the presence of high voltages.

This accordingly increases the risk of electrocution of a user who is not careful enough.

To resolve these problems, the invention offers a supply connector for a discharge lamp of the type which comprises an insulating housing in which an opening is provided for the axial introduction of a free end of the glass body of the discharge lamp comprising a longitudinal electrode formed by a front section which extends to the exterior of the body and a rear section which extends inside a front section of the free end of the body and which is designed to be supplied with a direct current, and of the type in which a contact blade is formed, which blade cooperates with the front section of the electrode for connecting the lamp to an electrical supply member, characterized in that it comprises an electrically conducting ring which is connected to ground, which is axially traversed by the front section of the free end of the glass body, and which is designed to be at least partly in contact with a portion of the outer wall of the glass body of the discharge lamp so as to facilitate the ignition of the latter.

According to further characteristics of the invention:

- the ring is elastically deformed upon the axial introduction of the front section of the free end of the lamp body so as to clamp around said portion of the outer wall of the body;
- the insulating housing is constructed with a front part having an open rear end and a rear part having an open front end, while in the rear end of said rear part an opening is realized for the axial introduction of the body of the lamp, said front and rear parts being assembled together in that the two parts, front and rear, are axially moved one into the other;
- the rear part comprises an accommodation space for positioning and mounting the contact blade;
- the rear part comprises an accommodation space for positioning and mounting the ring;
- the ring comprises a contact strip which extends axially above a portion of the contact blade, and at least one of the two parts of the insulating housing comprises an electrically insulating wall which extends axially between the contact blade and the contact strip so as to eliminate the risk of a discharge arc forming outside the glass body between the contact blade and the conducting ring;
- the insulating wall extends axially away from the front bottom portion of the front part, and the ring is axially retained by the rear free end of the insulating wall and the transverse rear bottom portion of the rear part;
- the contact blade is axially secured by the front bottom portion of the front part and locking means of the rear part;
- the contact blade is formed as an elastic clip which locks in the front section of the electrode and which cooperates with mating retention means of the electrode so as to define the axial position of the lamp with respect to the housing, in particular the axial position of the free rear end of the rear section of the electrode with respect to the ring;
- the front and rear parts comprise mating means for axial positioning and mutual locking;
- the supply connector comprises a flexible sealing element for the inlet opening, connected to the exterior of the housing.

The invention also relates to a luminaire for a discharge lamp comprising at least one connector as described hereinbefore.

Further characteristics and advantages of the invention will become clear from the following detailed description which is given with reference to the annexed drawings, in which.

Figure 5:
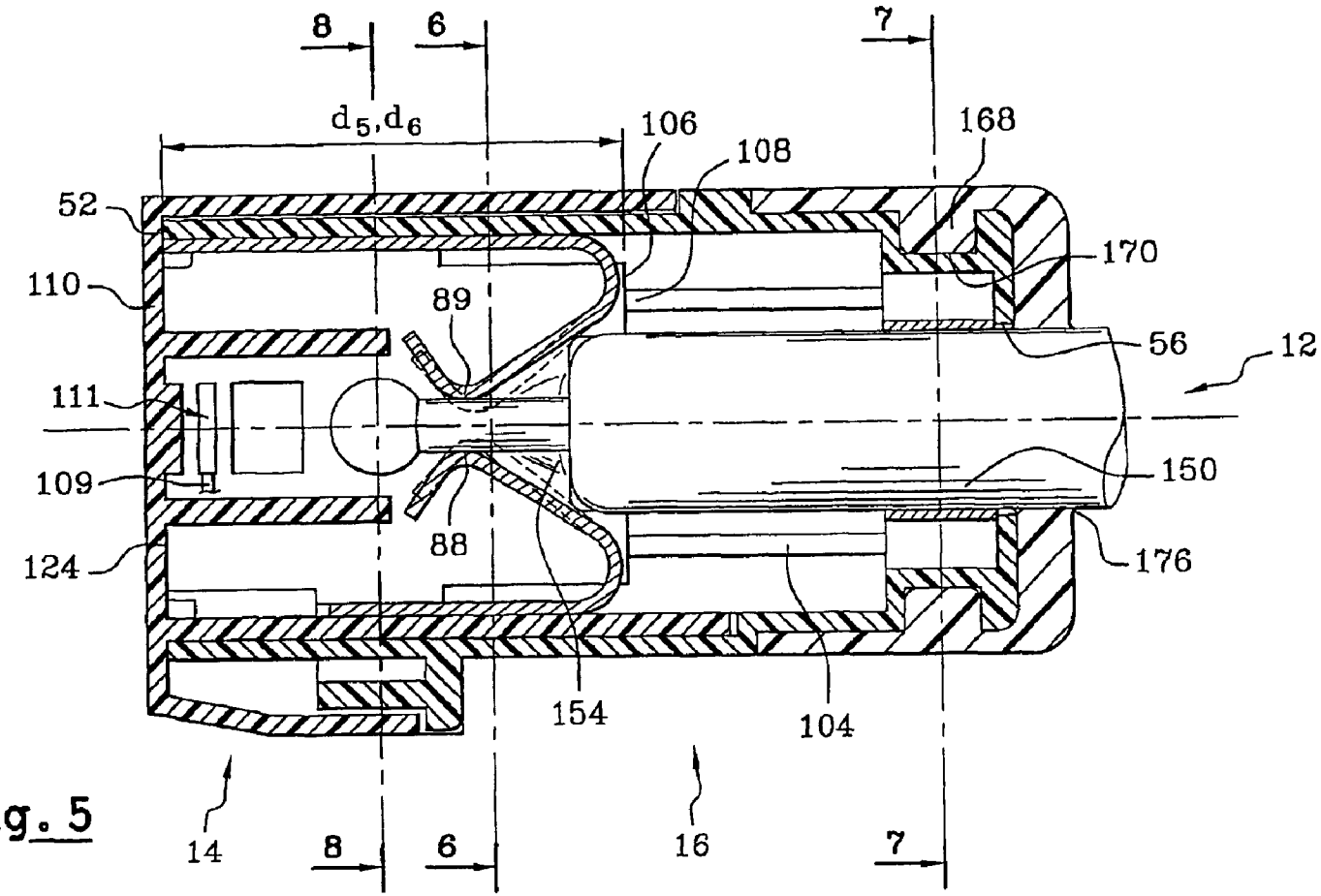
FIG. 5 is a cross-sectional view taken on the plane P5 in FIG. 2.
Figure 7A:
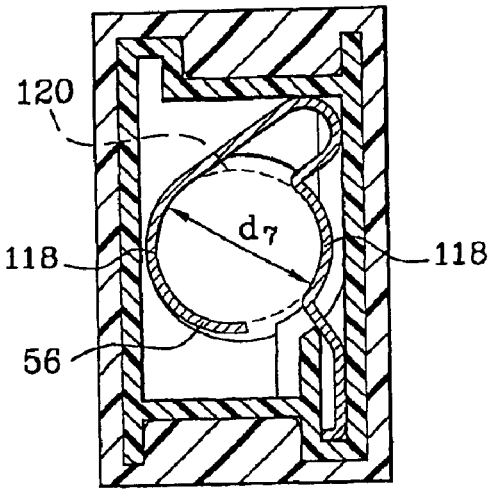
Figure 7B:
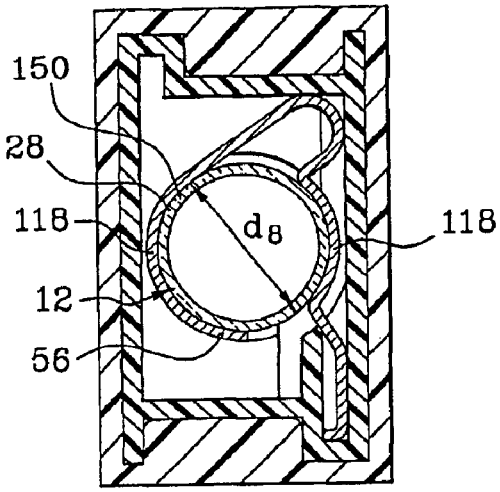
Figure 8:
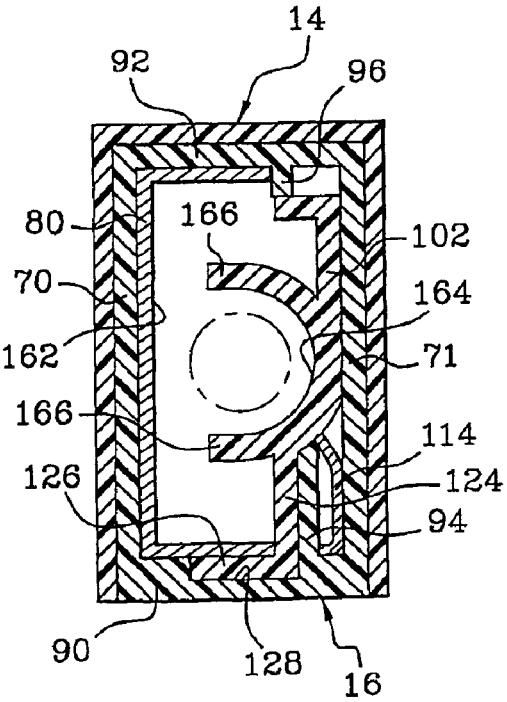

FIG. 7*a* is a cross-sectional view taken on the line 7—7 in FIG. 5;

FIG. 7*b* is a view similar to that of the preceding Figure, wherein the glass body of the discharge lamp has been introduced into the connector; and FIG. 8 is a cross-sectional view taken on the line 8—8 in FIG. 5.

Figure 1:
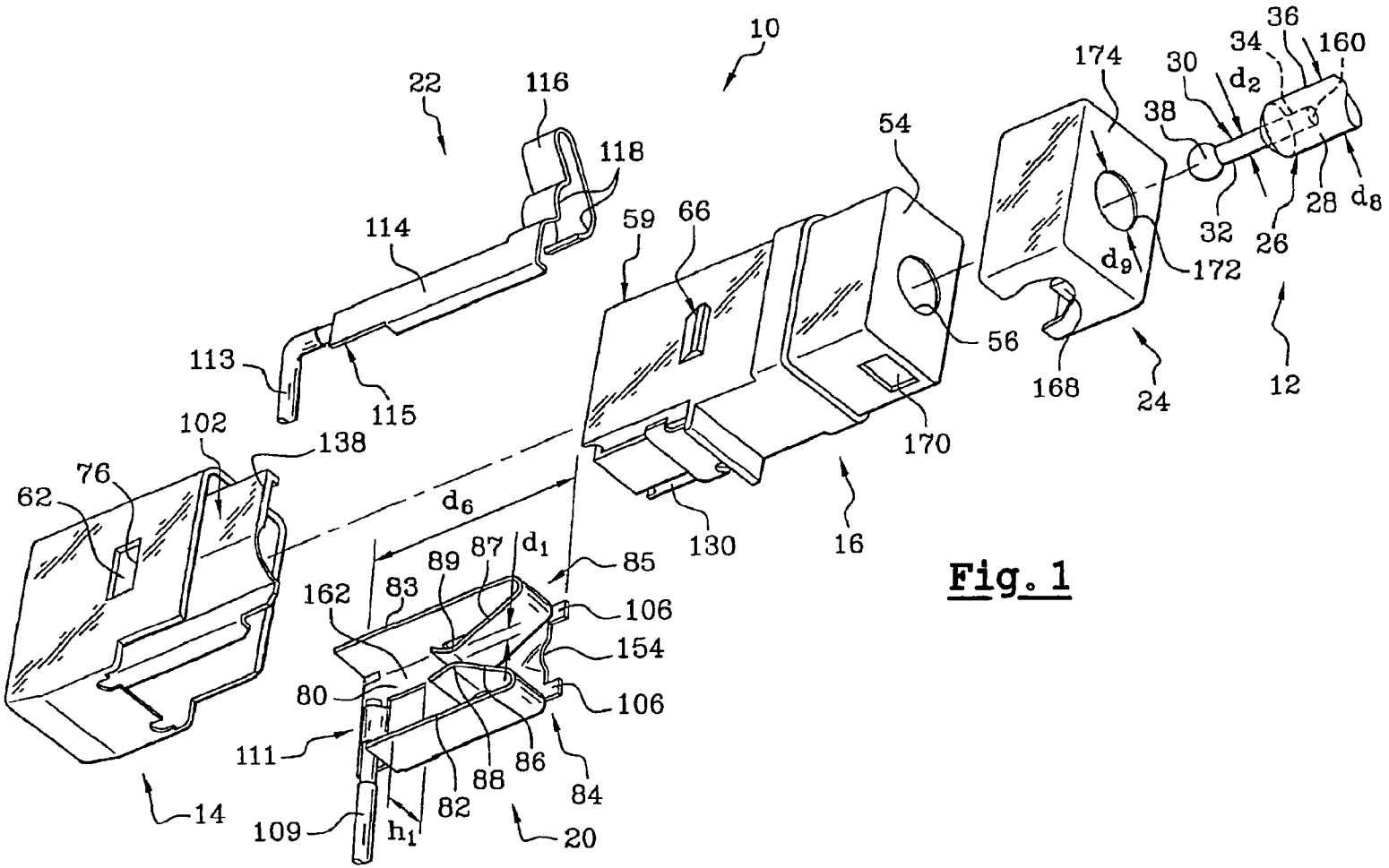
FIG. 1 is a perspective exploded view of the elements which form the supply connector constructed in accordance with the invention.

For a better understanding of the description and claims, a front/rear orientation conforming to the left/right orientation of FIG. 1 will be used, but this implies no limitation whatsoever.

FIG. 1 shows a perspective exploded view of a supply connector 10 of a discharge lamp 12.

The supply connector 10 is formed substantially by a front part 14 and a rear part 16 which together constitute a housing 18, a contact blade 20, an electrically conducting ring 22, and a flexible sealing element 24, also denoted "cover".

Figure 2:
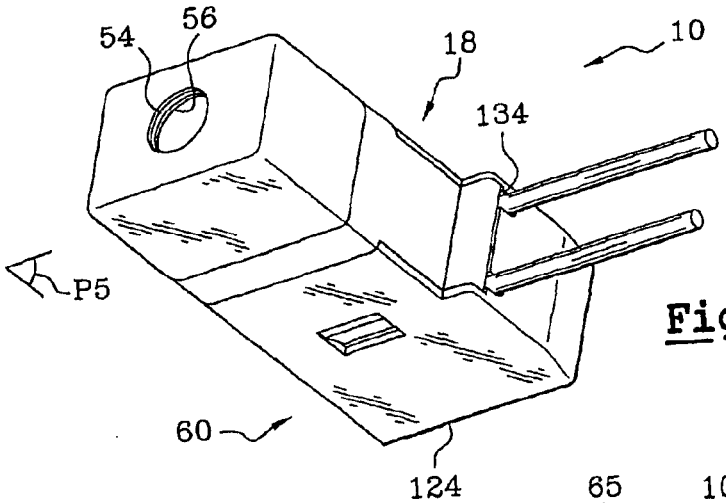
FIG. 2 is a perspective view of the assembled state of the supply connector of a discharge lamp constructed in accordance with the invention.

The supply connector 10 is shown in the assembled state in perspective view in FIG. 2.

The supply connector 10 is capable of receiving the free front end 26 of the tubular glass body 28 of the discharge lamp 12 in axial direction, which lamp comprises an electrode 30 which extends in longitudinal direction.

The electrode 30 is formed by a front section 32 which extends outside the body 28 and by a rear section 34 which extends inside a front section 36 of the free end of the body 28.

The electrode 30 shown in the Figures is the anode of the lamp 12, i.e. it is that electrode which is designed for being fed with a direct current provided by an electrical supply unit which is not shown.

The cathode (not shown) situated at the other free end of the glass body 28 of the discharge lamp 12 is similar, i.e. it is formed by a section inside and a section outside the body 28. The cathode is connected to the ground terminal of the electrical supply unit.

To facilitate the realization of the lamp 12, each electrode 30 consists of a tubular element whose free end of the section situated outside the body 28, here the front section 32, is closed off by means of, for example, a glass bead 38.

The air present inside the body 28 is thus driven out through one of the electrodes during the manufacture of the discharge lamp 12, and a gas, such as neon, is injected through the other electrode. When these operations have been concluded, the electrodes are closed with glass beads.

When the front section 36 of the lamp 12 is axially accommodated inside the connector 10, the contact blade 20 cooperates with the front section 32 of the electrode 30 so as to connect the lamp 12 to an electrical supply unit via a wire. The lamp can thus be supplied with a direct current at a voltage of the order of several thousands of volts.

The electrically conducting ring 22 is connected to the ground terminal of the electrical supply unit via another wire. When the front section 36 of the lamp 12 is axially held in the connector 10, the conducting ring 22 is axially traversed by the front section 36 of the free end of the glass body 28, and it is at least partly in contact with a portion of the outer wall of the body 28 so as to facilitate the ignition of the lamp.

Figure 3:
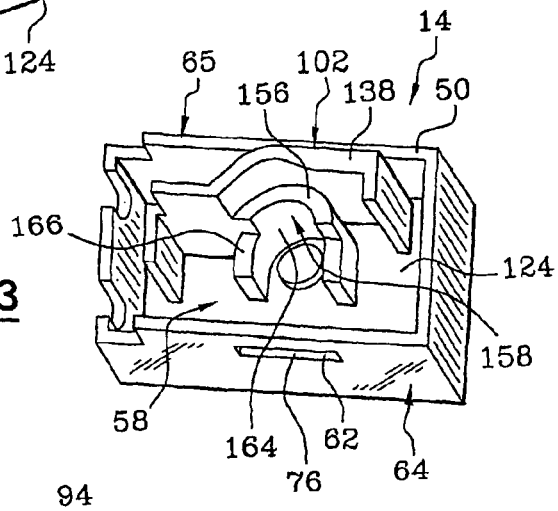
FIG. 3 is a perspective view of the interior of the front part of the supply connector.
Figure 4:
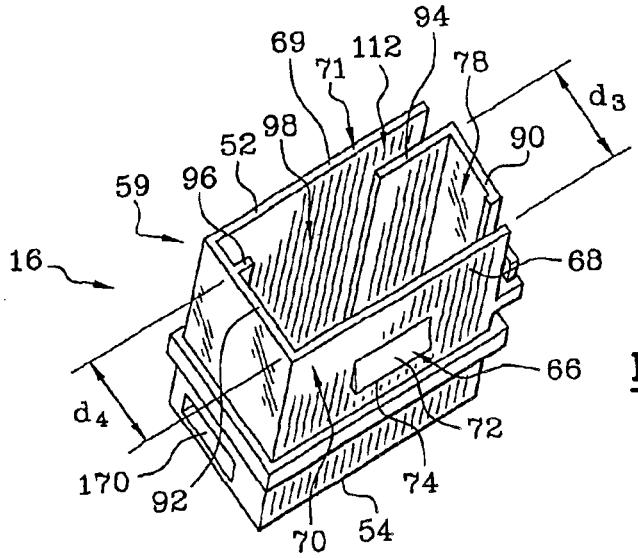
FIG. 4 is a perspective view of the interior of the rear part of the supply connector.

The front part 14 and the rear part 16, shown in perspective view in FIGS. 3 and 4, respectively, and together forming the housing 18 are realized here by molding from a plastic material, so that they are electrically insulating.

The front part 14 substantially has the shape of a parallelepiped whose rear face 50 is open.

Similarly, the rear part 16 also substantially has the shape of a parallelepiped whose front face 52 is open.

The rear face 54 of the rear part 16 has a circular opening 56 into which the body 28 of the discharge lamp 12 can be axially introduced.

The front 14 and rear 16 parts are designed for being boxed together axially one into the other.

To achieve this, the dimensions of the cavity 58 defined by the lateral walls of the front part 14 are somewhat greater than the external dimensions of the rear part 16.

Assembling together of the front part 14 and the rear part 16 then means that the free front end 59 of the rear part 16 is introduced into the cavity 58.

Once the front 14 and rear 16 parts have been assembled together, their assembly is immobilized by mutually locking means which are formed here by two holes 62 of rectangular shape provided in two mutually opposed lateral walls 64, 65 of the front part 14, into which two spigots 66 situated on the outer lateral surfaces 68, 69 of the opposed lateral walls 70, 71 of the rear part 16 corresponding to the lateral walls 64, 65 are introduced.

The spigots 66 have a triangular shape in axial section. An inclined surface 72 forming a ramp facilitates a slight deformation of the lateral walls 64 and 65 of the front part 14 during the introduction of the front free end 59 of the rear part 16. Another surface 74 of each spigot 66 forms a retention stop in contact with the rear edge 76 of the respective hole 62 when the front 14 and rear 16 parts are assembled together.

The two parts 14 and 16 are thus axially immobilized with respect to one another.

It is sometimes necessary to separate the two parts 16 and 14 again. To achieve this, the two lateral surfaces 64 of the front part 14 are to be slightly deformed in outward, transverse direction so as to disengage the surfaces 74 of the spigots 66 from the two rear edges 76 of the two holes 62.

The rear part 16 comprises an accommodation space 78 for positioning and mounting the contact blade 20.

The contact blade 20 here has the form of an elastic clip made from a metal sheet material.

The contact blade 20 comprises a base wall 80 which extends so as to make contact with the inner surface of the lateral wall 70. It also comprises two transverse walls 82 and 83 whose rear free ends 84 and 85 are curved towards the front so as to form the two arms or jaws 86 and 87 of the clip.

The height of the contact blade 20 is referenced $h_1$.

To ensure a clamping of the front section 32 of the electrode 30, the distance $d_1$ separating the clamping zones 88 and 89 of the arms 86 and 87 of the clip is smaller than the diameter $d_2$ of the electrode 30.

To promote the clamping and electrical contact of the clip and the front section 32 of the electrode 30, the clamping zones 88 and 89 each have a V-shape with tips facing one another.

The accommodation space 78 for positioning and mounting the contact blade 20 is delimited by the lateral wall 70 and by the transverse walls 90 and 92 of the rear part 16. In addition, the rear part 16 comprises a first and a second axial wing 94 and 96, which wings extend from the transverse walls 90 and 92, respectively, into the interior of the cavity 98 of the rear part 16.

Figure 6:
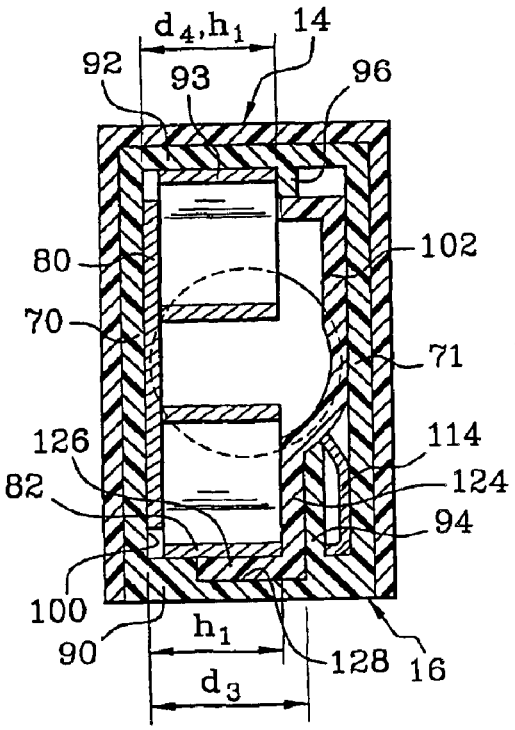
FIG. 6 is a cross-sectional view taken on the line 6—6 in the preceding Figure.

As is shown in the cross-sectional view of FIG. 6, the distance $d_3$ separating the inner surface 100 of the lateral wall 70 and the opposed surface of the wing 94 is greater than the height $h_1$ of the transverse wall 92 of the contact blade 20.

The difference between these two dimensions $d_3$ and $h_1$ corresponds to the thickness of an electrically insulating wall 102 of the front part 14, which will be explained in more detail below.

The distance $d_4$ separating the inner surface 100 of the lateral wall 70 and the opposing surface of the wing 96 is substantially equal to the height $h_1$ of the transverse wall 92 of the contact blade 20.

The contact blase 20 is accordingly guided in axial direction in the accommodation space 78.

Its positioning in axial direction is achieved by abutment means formed by abutment ridges 104 here, shown in FIG. 5, with which the extensions 106 of the bottom wall 80 of the contact blade 20 make axial contact.

The distance $d_5$ separating the free front ends 108 of the abutment ridges 104 and the front face 52 of the rear part 16 here corresponds to the axial dimension $d_6$ of the contact blade 20.

When the elements of the connector 10 are assembled together, therefore, the contact blade 20 will be immobilized axially by the front wall 110 of the front part 14 and the front free ends 108 of the abutment ridges 104 of the rear part 16.

The contact blade 20 is electrically connected to the electrical supply unit via a conducting wire 109 which is crimped onto a front zone 111 of the contact blade 20.

The rear part 16 further comprises an accommodation space 112 for positioning and mounting the ring 22, which space is delimited by the wing 94 and the lateral wall 71 of the rear part 16.

The conducting ring 22 comprises a contact strip 114 which extends axially in forward direction from its elastically deformable rear free end 116 which, according to the invention, is designed to be traversed axially by the front section 36 of the free front end 26 of the glass body 28 and which is designed to be at least partly in contact with a portion of the outer wall of the glass body 28 of the discharge lamp 12 so as to facilitate the ignition thereof.

In fact, the conducting ring 22 renders it possible in particular to define the electric potential of the portion of the outer wall of the body 28 with which it is in contact.

The conducting ring 22 is made from a metal foil which is cut and folded so as to have zones 118 designed for making contact with a portion of the outer wall of the glass body 28 of the discharge lamp 12.

The zones 118 substantially define portions of a circle 120 of diameter $d_7$ indicated with broken lines in FIG. 7*a*.

The conducting ring 22 is guided and positioned mainly by its contact strip 114 which extends in axial direction in the space 112 between the wing 94 and the lateral wall 71 of the rear part 16.

The conducting ring 22 is electrically connected to the electrical supply unit via a conducting wire 113 which is crimped onto a front zone 115 of the contact strip 114.

For assembling the connector 10, the conducting ring 22 is introduced into the rear part 16, in particular the contact strip 114 is introduced into the space 112, until its rear free end 116 abuts against the rear surface 54.

In a modification which is not shown, the rear part 16 may comprise means for stopping and axially positioning the conducting ring 20, which means extend inside the cavity 98.

The assembly of the connector 10 is achieved through introduction of the contact blade 20 into the space 78. The contact strip 114 of the ring 22 then extends in axial direction above a portion of the contact blade 20.

The front part 14 is subsequently assembled and is locked together with the rear part 16.

According to the invention, the rear part 16 comprises the electrically insulating wall 102 which extends axially to the rear from the front bottom portion 124 of the front part 14.

The electrically insulating wall 102 then extends axially between the contact blade 20 and the contact strip 114 so as to eliminate the risk of a discharge arc forming outside the glass body 28 between the contact blade 20 and the ring 22.

As is shown in FIG. 6, indeed, the contact strip 114 is separated from the contact blade 20 by the wall 102. The shape of the wall is defined such that the shortest path length to be traveled through the air between the contact blade 20 and the conducting ring 22 is greater than the air thickness which achieves an electrical insulation of two electrically conducting elements which are electrically supplied and whose potential difference corresponds to the potential difference between the contact blade 20 and the conducting ring 22 connected to ground during ignition and/or operation of the discharge lamp 12.

The thickness of the plastic material separating the contact blade 20 from the conducting ring 22 is determined such that it will resist the potential difference applied between said two conducting elements.

To optimize the electrical insulation of the contact blade 20 from the conducting ring 22, a reinforcement zone 124 of the electrically insulating wall 102 extends between the wing 94 and the contact blade 20. The reinforcement zone 124 is prolonged laterally by means of a return portion 126 which is accommodated in a groove 128 of the transverse wall 90 of the rear part 16 and which is situated opposite the transverse wall 82 of the contact blade 20.

This renders it possible to increase the thickness of insulating material between the two conducting elements 20 and 22, to increase the length of the path to be traversed through the air between the contact blade 20 and the conducting ring 22, and to position the assembly of the front 14 and rear 16 parts in axial direction.

Such a connector may thus be used if the anode is supplied with a voltage of several thousands of volts.

Similarly, the thickness of the plastic material separating the contact blade 20 from the exterior of the connector 10 is determined such that it will resist the potential difference applied between the contact blade 20 and any element capable of electrical conduction, such as a human finger or a piece of metal, situated outside the connector 10.

This renders it possible to avoid all risk of a discharge arc arising between the interior and the exterior of the connector 10, which could lead to the destruction of the connector as well as to a short-circuit of the supply unit and possibly the electrocution of a user.

The connector 10 may thus be used in a reliable and safe manner, allowing the user to manipulate it without any risk of electrocution, even though this is advised against, while the discharge lamp is being electrically supplied.

The conducting ring 22, whose rear free end 116 is in contact with the rear face 54, is locked against axial translations in forward direction by the rear free end 138 of the electrically insulating wall 102.

The conducting wires 111 and 113 for electrical connection of the contact blade 20 and the conducting ring 22 to the electrical supply unit are guided in grooves 130 provided in the exterior of the lateral surface 90 of the rear part 16 extending towards exit holes 132.

The connector 10 is used in that the front end 36 of the discharge lamp 12 is axially introduced in forward direction into the connector.

To optimize the contact of the zones 118 of the ring 22 with the outer wall of the glass body 28, the diameter $d_7$ of the zones 118 is made smaller than the outer diameter $d_8$ of the body 28 of the discharge lamp 12.

Thus when the discharge lamp 12 is axially introduced into the connector 10, the ring 22 will be elastically deformed so as to clamp around a portion 150 of the outer wall of the front section 36 of the free end of the body 28 of the lamp 12.

The passage of the glass bead 38 between the V-shaped clamping zones 88 and 89 causes the arms 86 and 87 of the clip to move apart, followed by their partial return in an elastic manner.

In fact, the front section 32 of the electrode 30 is clamped in by the clamping zones 88 and 89 of the arms 86 and 87 of the clip so as to safeguard the contact and the passage of an electric current.

FIG. 5 shows the arms 86 and 87 in their clamping position in bold lines, and the arms 86 and 87 in idle position in broken lines, i.e. before the axial introduction of the discharge lamp 12.

The passage of the glass bead 38 between the clamping zones 88 and 89 gives rise to a temporary resistance to the introduction. This allows the user to determine when the lamp has been correctly positioned.

The movement of axial introduction of the lamp 12 is stopped in forward direction by a zone 154 of the contact blade 20 which is deformed towards the interior of the connector 10 as well as by the surface of the rear free end 156 of a thickened portion 158 of the insulating wall 102.

The glass bead 38 has the function not only of sealing off the interior of the body 28 of the discharge lamp 12, but also of limiting the axial removal of the lamp 12.

In fact, when the discharge lamp 12 is pulled axially towards the rear, the arms 86 and 87 must again be elastically deformed so as to allow the glass bead 38 to pass. The V-shape of the clamping zones 88 and 89 renders possible the removal of the discharge lamp 12.

The elastic deformation of the arms 86 and 87, however, necessitates a given axial effort for pulling the lamp 12 from the connector 10.

The cooperation of the glass bead 38 accordingly prevents an inadvertent removal of the lamp 12.

The connector 10 according to the invention serves to keep the lamp 12 in place, while rendering possible its exchange in a simple and fast manner.

The zone 154 of the contact blade 20, the portion 158 of increased thickness of the insulating wall 102, and the cooperation of the glass bead 38 with the arms 86 and 87 all work together to retain the lamp 12 and to define its axial position with respect to the housing 18.

This renders it possible in particular to define the axial position of the free end 160 of the rear section 34 of the electrode 30 with respect to the rear free end 116 of the conducting ring 22.

This relative positioning is very important because it is one of the factors governing the ease of ignition of the discharge lamp 12.

When the discharge lamp 12 is axially introduced into the connector 10, the transverse movements of the front section 32 of the anode 30 are limited, in particular by the glass bead 38.

As is shown in FIG. 8, indeed, they are limited by the inner surfaces 162 and 164 of the bottom wall 80 and of the electrically insulating wall 102, respectively, as well as by two strips 166 which extend transversely in a direction substantially perpendicular to the inner surface 164 of the electrically insulating wall 102.

The flexible sealing element 24 is provided on the outside of the housing 18, on the rear end of the rear part 16.

It comprises two spigots 168 cooperating with two depressions 170 provided in the transverse walls 90 and 92 of the rear part 16 so as to keep said element in place.

The flexible sealing element 24 may be made from an elastomer material.

A hole 172 is provided in the rear wall 174 so as to allow the axial introduction of the discharge lamp 12.

The diameter $d_9$ of the hole 172 is slightly smaller than the outer diameter of the body 28 of the discharge lamp 12. When the lamp 12 is introduced into the connector 10, therefore, the peripheral edge 176 of the hole 172 will be in contact with the body 28.

Advantageously, see FIG. 5, the peripheral edge 176 is compressed against the body 28 and is slightly deformed.

The flexible sealing element 24 thus renders it possible to limit the introduction, especially of dust and humidity, into the interior of the connector 10.

It also has a cushioning function. If the discharge lamp 12 is subjected to vibrations, the peripheral edge 176 in contact with the lamp will dampen these vibrations so as to limit wear of the lamp 12.

The flexible sealing element 24 also serves to prevent the body 28 from damaging the peripheral edge of the axial introduction hole 56 provided in the rear part 16 when the discharge lamp is subjected to vibrations.

A similar connector may be used for connecting the cathode of the discharge lamp 12.

During operation of the lamp 12, the temperature of the cathode is high, of the order of 300° C., which may lead to a deterioration of other components situated in the vicinity or may lead to burns of a user who touches the electrode. The connector 10 according to the invention renders it possible to protect the cathode and to insulate it thermally from the exterior.

In fact, the temperature of the outer surfaces of a housing used for the connection of a cathode will not exceed a value of 100 to 120° C.

What is claimed is:

1. A supply connector (10) for a discharge lamp (12) which comprises an insulating housing (18) in which an opening (56) is provided for axial introduction of a free end (26) of a glass body (28) of the discharge lamp (12) comprising a longitudinal electrode (30) formed by a front section (32) which extends to an exterior of the glass body (28) and a rear section (34) which extends inside a front section (36) of a free end of the glass body (28) and which is designed to be supplied with a direct current, and the supply connector having a contact blade (20) which blade cooperates with the front section (32) of the electrode (30) for connecting the lamp (12) to electrical supply member, characterized in that the supply connector comprises an electrically conducting ring (22) which is connected to ground, which is axially traversed by the front section (36) of the free end of the glass body (28), and which is designed to be at least partly in contact with a portion (150) of an outer wall of the glass body (28) of the discharge lamp (12) so as to facilitate ignition of the discharge lamp.

2. A supply connector (10) as claimed in claim 1, characterized in that the ring (22) is elastically deformed upon the axial introduction of the front section (36) of the free end of the glass body (28) of the lamp (12) body so as to clamp around said portion (150) of the outer wall of the glass body (28).

3. A supply connector (10) as claimed in claim 1, characterized in that the insulating housing (18) is constructed with a front part (14) having an open rear end (50) and a rear part (16) having an open front end (52), while in the rear end (54) of said rear part (16) an opening (56) is provided for the axial introduction of the body (28) of the lamp (12), said front (14) and rear (16) parts being assembled together in that the two parts, front (14) and rear (16), are axially fitted together.

4. A supply connector (10) as claimed in claim 1, characterized in that the rear part (16) comprises an accommodation space (78) for positioning and mounting the contact blade (20).

5. A supply connector (10) as claimed in claim 3, characterized in that the rear part (16) comprises an accommodation space (112) for positioning and mounting the ring (22).

6. A supply connector (10) as claimed in claim 3, characterized in that the ring (22) comprises a contact strip (114) which extends axially above a portion of the contact blade (20), and at least one of the two parts (14, 16) of the insulating housing (18) comprises an electrically insulating wall (102) which extends axially between the contact blade (20) and the contact strip (114) so as to eliminate risk of a discharge arc forming outside the glass body (28) between the contact blade (20) and the conducting ring (22).

7. A supply connector (10) as claimed in claim 6, characterized in that the insulating wall (102) extends axially away from the front bottom portion (124) of the front part (14), and the ring (22) is axially retained by rear free end (138) of the insulating wall (102) and the transverse rear bottom portion of the rear part (16).

8. A supply connector (10) as claimed in claim 3, characterized in that the contact blade (20) is axially secured by a front bottom portion (124) of the front part (14) and locking means (104) of the rear part (16).

9. A supply connector (10) as claimed in claim 1, characterized in that the contact blade (20) is formed as an elastic clip which locks in the front section (32) of the electrode (30) and which cooperates with mating retention means (38, 154) of the electrode (30) so as to define an axial position of the lamp (12) with respect to the housing (18), in particular the axial position of the free rear end (160) of the rear section (34) of the electrode (30) with respect to the ring (22).

10. A supply connector (10) as claimed in claim 3, characterized in that the front (14) and rear (16) parts comprise mating means (66, 62) for axial positioning and mutual locking.

11. A supply connecter (10) as claimed in claim 1, which further comprises comprises a flexible sealing element (24) for the opening (56), connected to the exterior of the housing (18).

12. A luminaire for a discharge lamp comprising at least one connector as claimed in claim 1.

* * * * *